US006261415B1

(12) United States Patent
Johansson et al.

(10) Patent No.: US 6,261,415 B1
(45) Date of Patent: Jul. 17, 2001

(54) PAPER MACHINE

(75) Inventors: Per Anders Johansson, Karlstad; Mikael Nyman, Forshaga, both of (SE)

(73) Assignee: Valmet Karlstad AB, Karlstad (SE)

( * ) Notice: Subject to any disclaimer, the term of this patent is extended or adjusted under 35 U.S.C. 154(b) by 0 days.

(21) Appl. No.: 09/383,809

(22) Filed: Aug. 26, 1999

Related U.S. Application Data

(60) Provisional application No. 60/109,644, filed on Nov. 24, 1998.

(30) Foreign Application Priority Data

Aug. 28, 1998 (SE) ..... 9802890

(51) Int. Cl.[7] ..... D21F 1/36

(52) U.S. Cl. ..... 162/193; 162/286; 162/191; 162/194; 162/195; 162/198; 162/264; 162/306; 162/358.1; 162/289; 162/DIG. 10; 162/DIG. 11; 162/202

(58) Field of Search ..... 162/191, 193, 162/194, 195, 198, 264, 286, 306, 358.1, 289, DIG. 10, DIG. 11, 202

(56) References Cited

U.S. PATENT DOCUMENTS 4,909,903 3/1990 Müllner .
5,932,070 * 8/1999 Esslinger ..... 162/199

FOREIGN PATENT DOCUMENTS

| | | |
|---|---|---|
| 195 11 988 C1 | 3/1995 | (DE) . |
| 0 584 492 B1 | 6/1993 | (EP) . |
| 0 598 991 B1 | 8/1993 | (EP) . |
| 1 284 119 | 9/1969 | (GB) . |

* cited by examiner

*Primary Examiner*—Peter Chin
*Assistant Examiner*—M. Halpern
(74) *Attorney, Agent, or Firm*—Alston & Bird LLP

(57) ABSTRACT

A paper machine and web control system for the same to be activated on web rupture, which paper machine has a double-felted press nip and a treatment unit for increasing the dry solids content of the web downstream of the press nip, the web being transferred from the press nip to the treatment unit in an open draw. The web control system has a water-application device arranged at the open draw to discharge jets of water against the upper press felt on rupture of the web so as to prevent an upstream end of the web continuing with the upper press felt, a felt-deflection device situated downstream of the press nip to bring the press felts into contact with each other downstream of the press nip on rupture of the web so as to sandwich the web between the felts, and a suction device in the loop of the lower press felt at a position between the press nip and the felt-deflection device to temporarily attach the web to the lower press felt by suction.

23 Claims, 2 Drawing Sheets

PAPER MACHINE

CROSS-REFERENCE TO RELATED APPLICATION

This application claims the benefit of U.S. Provisional Patent Application Serial No. 60/109,644 filed Nov. 24, 1998.

FIELD OF THE INVENTION

The present invention relates to a paper machine for manufacturing a continuous paper web. The invention relates more particularly to a paper machine having devices for controlling the path of travel of a web in an open draw downstream of a press nip of a double-felted press upon rupture of the web in the open draw, such that the web does not adhere to and travel with either of the press felts of the press.

BACKGROUND OF THE INVENTION

In a paper machine having a double-felted press for dewatering the web coming from a wet section of the machine, the wet paper web is passed through a press nip defined between two press members with the web sandwiched between a pair of absorbent press felts that also pass through the press nip. The web typically passes from the press nip to a further treatment unit, usually including one or more dryers, for further increasing the dry solids content of the web. In some types of paper machines, the web traverses an open draw between the press nip and the treatment unit. More particularly, the two press felts diverge from each other after the press nip, and the paper web separates from both of the felts and travels unsupported to the treatment unit, where it typically is picked up by a clothing of the treatment unit for carriage through the treatment unit.

One of the problems associated with such machines employing an open draw between a press nip and a treatment unit is that upon a web rupture occurring in the open draw, the leading end of the web created by the rupture tends to adhere to and travel with one of the press felts rather than separating from such felt as desired. This occurs because the forces on the web tending to separate it from the press felts are created by the web tension imparted by handling devices of the downstream treatment unit. When the web ruptures in the open draw, this web tension no longer acts on the web leading end, and thus the web tends to adhere to one of the felts.

Various prior art references disclose paper machines having double-felted press sections, but the known references do not address the above-noted problem associated with web rupture in an open draw. EP-0 598 991 describes a double-felted press section in a paper machine in which the upper press felt and lower press felt each travel about a guide roll, and wherein each guide roll is adjustable in relation to the paper web. During operation (see FIG. 3), the web is carried by the upper felt after the nip and transferred to the lower felt at a subsequent press. During operation, therefore, the web does not pass through any open draw.

EP-0 584 492 describes a system for threading a web in a press section that has a double-felted nip, but the system does not include an open draw.

U.S. Pat. No. 4,909,903 describes a double-felted shoe press, where the upper press felt and lower press felt each are guided about an adjustable guide roll and the web is free from contact with either of the felts after the press nip. The adjustable guide rolls are selectively positioned so as to vary an angle between the web and each of the two felts for controlling a licking-up process during which a leader of the web is threaded through the machine. The rolls are adjusted such that during the licking-up process, the wetter one of the felts is guided at a larger angle relative to the web, compared to the angle that exists during continuous operation, and thus the leader tends to separate from the wetter felt at a location closer to the press nip so as to minimize rewetting of the leader by the wetter felt. The patent does not disclose any devices or methods for controlling the path of travel of the web upon a rupture of the web in the free draw that follows the press nip.

GB-1 284 119 describes a double-felted press nip, where the upper press felt has a guide roll in its loop which is moved to a lower position to deflect the upper felt into contact with the lower felt during threading. During operation, the web is carried by the lower felt. There is no open draw in this known configuration.

DE-195 11 988 shows a press section that has a double-felted shoe press (FIG. 2), where the upper press felt runs around an adjustable guide roll located downstream of the press nip. A pick-up roll is arranged a relatively short distance from the counter roll of the shoe press. The adjustable guide roll can be set in a plurality of different positions, in some of which the upper press felt carries the web up to the pick-up roll. In one position of the adjustable guide roll, the upper press felt is caused to stand clear of the web so that the web runs in an open draw. The problem of web rupture in the open draw is not addressed in the patent specification, nor is any method mentioned or device shown to deal with this problem.

SUMMARY OF THE INVENTION

The invention seeks to overcome the aforementioned problems associated with web rupture in an open draw downstream of a double-felted press nip. In accordance with the invention, a web control system is provided that quickly and efficiently prevents the paper web from accompanying a press felt when a web rupture occurs in the open draw. The web control system preferably also ensures that the web is conveyed to a reject handling station and that threading can be performed so as to quickly restore the paper machine to normal operation.

In accordance with a preferred embodiment of the invention, a paper machine comprises a wet section, a press section, a treatment unit, and a web control system. The press section includes a double-felted press having a first press member and a second press member defining a nip therebetween, a first press felt arranged to travel in a loop through the press nip and around a first guide roll located downstream of the press nip, and a second press felt arranged to travel in a loop through the press nip and around a second guide roll located downstream of the press nip, the guide rolls being located in relation to each other such that the press felts diverge from each other after the press nip. The treatment unit is located downstream of the double-felted press and is operable for increasing the dry solids content of the web. The web during normal operation traverses an open draw downstream of the press nip and upstream of the treatment unit. The web control system is activatable upon a rupture of the web in the open draw so as exert force on the web to prevent the web from adhering to the first press felt. Preferably, the web control system includes a detector disposed near the open draw for detecting a web rupture, and a controller coupled with the detector and with one or more web-control devices. The controller activates the one or more web-control devices upon receipt of a signal from the detector indicating that a web rupture has occurred in the open draw.

The web-control devices can include one or more of a water-application device, a felt-deflecting device, and a suction device. The water-application device is disposed proximate the first press felt and the open draw, and is operable to direct jets of water against the first press felt to urge the web away from the first press felt so that the web does not adhere to and travel with the first press felt downstream of the press nip. The water-application device advantageously comprises a pipe having one or more nozzles for discharging jets of water. The water-application device can also include additional nozzles for directing jets of water into the open draw to sever the web traversing the open draw when an abnormal condition is detected in the treatment unit of the paper machine. For example, where a web rupture in the treatment unit is detected, it is desirable to prevent the web from continuing to be delivered to the treatment unit. Accordingly, the water-application device can sever the web in the open draw. Simultaneously, the water-application device urges the web away from the first press felt and toward the second press felt. The web thus adheres to and travels with the second press felt downstream of the press nip. A reject-handling station can be provided for receiving the web material that is carried by the second press felt.

The felt-deflection device of the web control system is operable to deflect one of the press felts toward the other after the press nip so as to cause the felts to come together with the web sandwiched therebetween. The felt-deflection device advantageously comprises a movable guide roll disposed within the loop of one of the press felts and movable so as to deflect the felt toward the other felt. An advantageous arrangement is provided wherein the movable guide roll comprises the guide roll that guides the press felt after the nip during normal operation of the paper machine. The guide roll is movable between a normal operating position and a felt-deflecting position. Preferably, the guide roll is within the loop of the first press felt, although it can alternatively be disposed within the loop of the second press felt.

The suction device of the web control system is operable to suction the web onto the second press felt in the event of a web rupture in the open draw. The suction device advantageously operates in conjunction with the felt-deflecting device, such that when the web is sandwiched between the two press felts to create a sandwich construction, the suction device is disposed against the second press felt in the region of the sandwich construction for suctioning the web onto the second press felt. The suction device thereby prevents the web from adhering to the first press felt.

In a further preferred embodiment of the invention, the treatment unit of the paper machine includes a clothing that travels in a loop about a plurality of guide rolls for carrying the paper web about one or more treatment rolls such as drying cylinders. The web during normal operation traverses the open draw and is picked up by the clothing for carriage through the treatment unit. Following a web rupture in the open draw, the leading end of the web preferably is directed onto the second press felt by the web control system and is carried by the second press felt downstream of the press nip, as described above. To facilitate threading the leading end of the web into the treatment unit, the paper machine advantageously includes a clothing-deflection device for deflecting the clothing into proximity with the second press felt such that the clothing can pick up the web. The clothing-deflection device preferably comprises a movable guide roll disposed within the loop of the clothing. The guide roll is movable between a normal operating position and a clothing-deflecting position. Advantageously, a blower is provided for blowing the web onto the clothing when the clothing is moved toward the second press felt. The clothing-deflection device advantageously operates in conjunction with the felt-deflecting device such that the first press felt and the clothing are moved in concert toward the second press felt. Alternatively, the felt-deflection device can be arranged to deflect the second press felt toward the first press felt and toward the clothing.

DETAILED DESCRIPTION OF THE INVENTION

Figure 1:
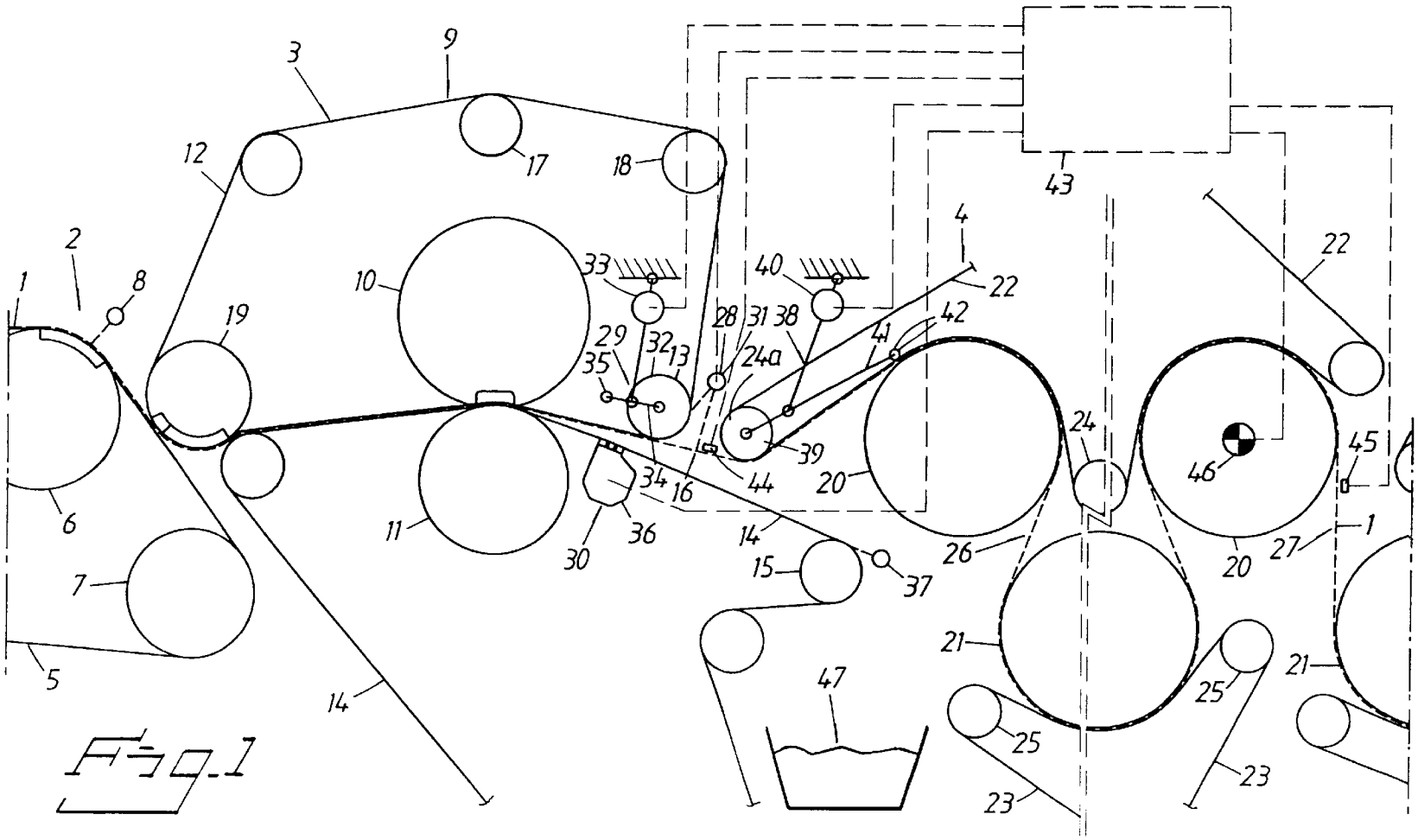
FIG. 1 schematically depicts a paper machine in accordance with a preferred embodiment of the invention having a double-felted press followed by an open draw to the next treatment unit, wherein the web is shown in its run during normal operation.
Figure 2:
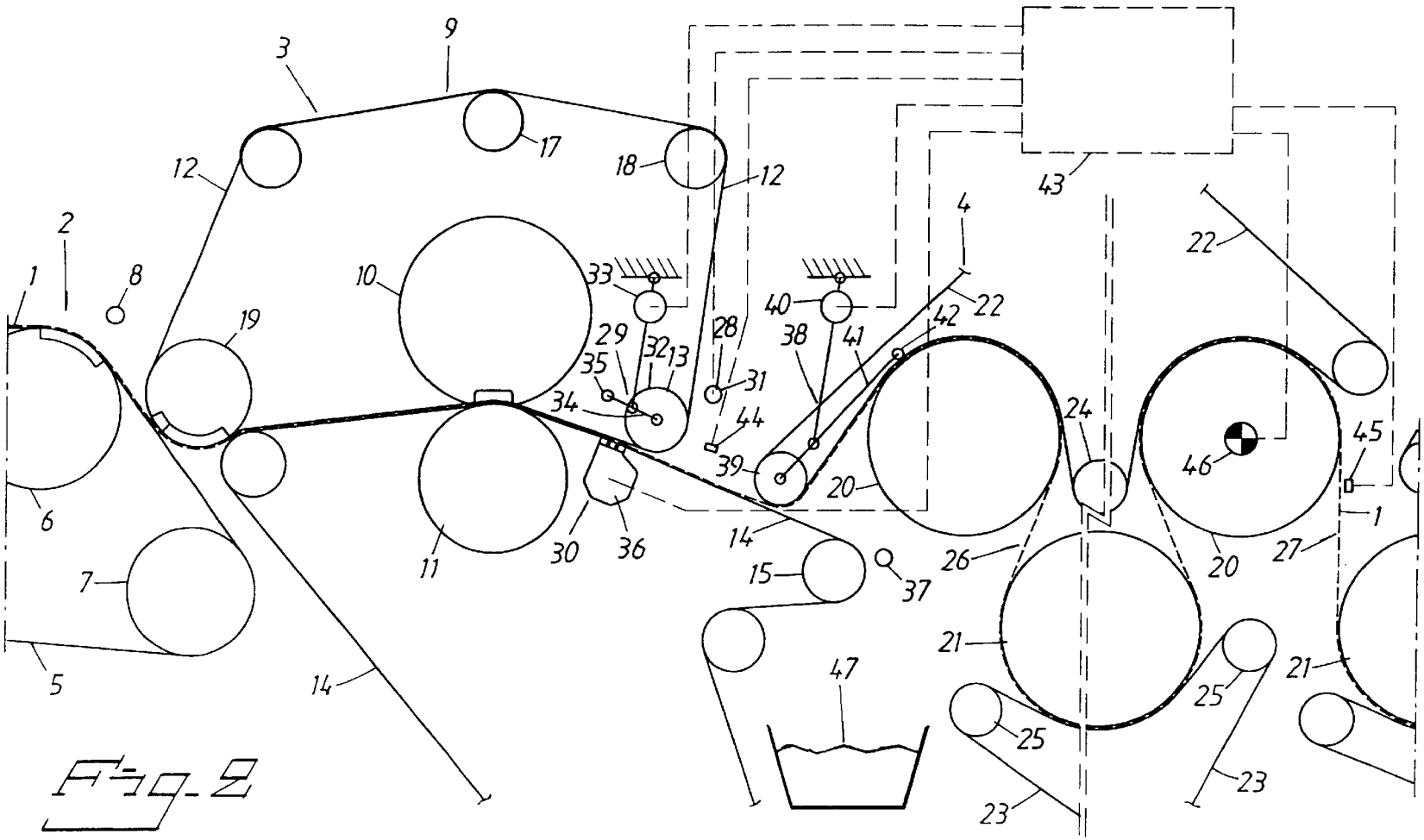
FIG. 2 shows the paper machine in accordance with FIG. 1 in a configuration when a web rupture has occurred in the open draw and threading has been carried out.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Parts of a paper machine for manufacturing a continuous paper web 1 are shown schematically in the drawings. The paper machine comprises a wet section 2, a press section 3 for initial dewatering of the web, and a treatment unit 4 for further increasing the dry solids content of the paper web.

The wet section 2 comprises a former having a clothing 5 that runs in an endless loop around several rolls including a suction roll 6 and a guide roll 7. The clothing 5 may be a forming wire or a fourdrinier wire depending on what type of former is used. The wet section has a couch squirt 8, which is arranged in the proximity of the suction roll 6 and which is activated at start-up or in the event of web rupture in order to discharge a sharp water jet against the clothing 5 so as to separate a leader from the paper web.

In the embodiment shown, the press section 3 comprises a double-felted press 9, which has an upper press member 10 and a lower press member 11, which press members 10, 11 define a nip with each other. The press 9 is a shoe press with a shoe press roll as upper press member 10 and a counter roll as lower press member 11. The counter roll 11 may be a smooth roll, a grooved roll, or a blind-drilled roll. The press nip is thus an extended press nip. The invention, however, is not limited to any particular type of press, the shoe press 9 being shown for illustrative purposes only. The shoe press 9 includes an upper press felt 12 running in an endless loop through the extended press nip and around several guide rolls, of which one guide roll 13 is located downstream of the press nip for upwards deflection of the press felt 12 after the nip, and a lower press felt 14 running in a loop through the press nip and around several guide rolls, of which one guide roll 15 is located downstream of the press nip for downwards deflection of the press felt 14 after the nip. Thus, the two guide rolls 13, 15 are located in relation to each other such that the press felts 12, 14 diverge from each other after the press nip and the paper web 1 is carried by the upper press felt 12 up to the guide roll 13. At the guide roll 13, the web is transferred from the upper press felt 12 and thereafter traverses an open draw 16 to the subsequent treatment unit 4 for further increase of the dry solids content. The guide roll 15 of the lower press felt 14 is arranged at a greater distance from the press nip than the guide roll 13 of the upper press felt 12 so that the lower press felt 14 passes under and past the open draw 16.

Reference numbers 17 and 18 denote guide rolls in the loop of the upper press felt, which function as stretch roll and tension roll, respectively. The loop of the lower press felt contains a similar arrangement (not shown).

In the embodiment shown, the upper press felt 12 is also used as a pick-up felt, which then runs around a suction roll 19 arranged close to the clothing 5 of the wet section so as to define a transfer zone downstream of the suction roll 6 around which the clothing 5 runs. The web 1 is picked up by the upper press felt 12 at the transfer zone and is carried by the upper press felt through the double-felted press 9.

The treatment unit 4 is located downstream of the double-felted shoe press 9, and the paper web 1 is transferred from the double-felted shoe press 9 over the open draw to the treatment unit 4. In the embodiment shown, the treatment unit 4 is a drying section comprising a plurality of drying cylinders 20, 21, which are arranged in upper and lower horizontal rows and in two or more groups. The paper web 1 runs in a meander-shaped manner so that it travels around approximately half of the circumference of each drying cylinder 20, 21. Each group of drying cylinders 20, 21 has upper and lower drying clothings 22, 23. Each drying clothing 22, 23 runs in a loop around guide rolls 24, 25 and around the drying cylinders 20, 21 in a zigzag-shaped pattern. The drying clothings 22, 23 enclose a slightly smaller sector of the drying cylinders 20, 21 than the paper web 1. As shown in FIG. 1, the paper web runs in open draws 26 between the drying cylinders 20, 21 in each group and in an open draw 27 between the last drying cylinder 20 in a group of drying cylinders and the first drying cylinder 21 in the following group of drying cylinders. Out of the guide rolls of the first drying clothing 22, one guide roll 24*a* is located first and closest to the shoe press and is arranged in a pre-determined position for normal operation at a distance from the lower press felt 14 and thus also at a distance from the guide roll 13 of the upper press felt 12 to form the open draw 16 between these guide rolls 13, 24*a*.

The paper machine in accordance with the invention comprises a web control system having one or more web-control devices designed to be activated in the event of web rupture in order to control the route of the paper web after the web rupture and to secure effective threading, which is carried out after the web rupture. The web control system comprises a water-application device 28, a felt-deflection device 29 and a suction device 30.

The water-application device 28 is arranged in proximity to the open draw 16 and in proximity to the upper press felt 12 in order to discharge jets of water, in the event of a web rupture, across and against the upper press felt 12 between its edge portions so as to prevent the leading end of the paper web resulting from the web rupture from adhering to and traveling with the upper press felt 12. The water-application device 28 comprises a squirt pipe 31 mounted across the machine direction at a suitable distance from the upper press felt 12 and at distance from the open draw 16 which substantially corresponds to the diameter of the guide roll 13. The squirt pipe 31 has a first row of nozzles that are aimed diagonally down towards the upper press felt 12 and a second row of nozzles that are aimed directly down towards the open draw 16 and the lower press felt 14. The nozzles in each row are arranged close to each other in such a way that a continuous curtain of jets of liquid is obtained between the edges or edge portions of the press felt 12 or the edges of the paper web 1, respectively. The second row of nozzles is activated primarily in order to forcibly achieve a web rupture in the open draw 16 when a web rupture has occurred in the drying section.

The felt-deflection device 29 is arranged at a pre-determined distance from and downstream of the press nip in order to bring the two press felts 12, 14 into contact with each other downstream of the press nip in the event of a web rupture, enclosing the paper web 1 between them to form a sandwich construction of a length which extends from the press nip to the felt-deflection device 29, or to the guide roll 15 located downstream of the press nip if the felt-deflection device 29 is located downstream of this guide roll 15 in the loop of the lower press felt 14. The felt-deflection device 29 comprises a felt-deflection roll 32 and an actuator 33 for moving the felt-deflection roll 32 from a first position to a second position so as to deflect the one press felt 12 or 14 into contact with the other press felt 14 or 12, respectively. In the embodiment shown, the felt-deflection device 29 is mounted in the loop of the upper press felt 12, and the felt-deflection roll 32 consists of the guide roll 13 located downstream of the press nip, which guide roll for its additional function is provided with support members 34 and bearing members 35. The support member 34 consists of support arms that are pivotably journalled on the shaft pins of the guide roll 13, and the bearing members 35 comprise bearing pins mounted outside the periphery of the guide roll 13. The actuators 33 consist of screw jacks that are pivotably connected with their racks to the support arms 34 at pivot points located at a distance from the bearing pins of the support arms 34. These pivot points may coincide with the shaft pins of the guide roll 13 if there is sufficient room.

The suction device 30 of the web control system comprises a suction box 36 arranged in the loop of the lower press felt 14 in a position downstream of the extended press nip and at a shorter distance from the nip than the distance between the nip and the guide roll 13 of the upper press felt 12.

A blower 37 is arranged in proximity to the first guide roll 15 of the lower press felt 14 in a location before the press felt 14 is deflected thereby in order to direct an air stream against the leader so as to force the same towards the drying clothing. The blower 37 may be stationary or manually movable.

The web control system shown further comprises a clothing-deflection device 38 arranged in the loop of the upper drying clothing 22 in order to bring the drying clothing 22 into contact with the lower press felt 14 of the shoe press 9 in the event of web rupture and subsequent threading. The clothing-deflection device 38 comprises a clothing-deflection roll 39 and an actuator 40 for moving the clothing-deflection roll 39 from a first upper position to a second lower position so as to deflect the drying clothing 22 to the lower press felt 14 of the shoe press 9. In the embodiment shown, the clothing-deflection device 39 consists of the first guide roll 24*a*, which for its additional function is provided with support members 41 and bearing members 42. The support members consist of support arms that are pivotably journalled on the shaft pins of the guide roll 24*a*, and the bearing members 42 comprise bearing pins mounted outside the periphery of the guide roll 24*a*. The actuators 40 consist of screw jacks that are pivotably connected with their racks to the support arms 41 at pivot points located at a distance from the bearing pins of the support arms 41. These pivot points may coincide with the shaft pins of the guide roll 24*a* if there is sufficient room.

The web control system of the paper machine further comprises a control unit 43 and a detector 44, 45 in connection with each open draw 16, 27 of the paper machine in which a web rupture can occur or be detected. Such detectors may, of course, also be arranged in the other open draws 26 in the drying section. The detectors 44, 45 are connected to the control unit 43, which also has connections to the actuators 33, 40 of the two clothing-deflection devices, to the squirt pipe 31, to the suction box 36 and to a drive member 46 of the last drying cylinder 20 in the first group of drying cylinders 20, 21 and, possibly, to further drive members of the other drying cylinders in the group.

During operation, the paper web 1 runs through the extended press nip enclosed between the two press felts 12, 14. After the extended press nip, the paper web 1 is carried by the upper press felt 12, which has a higher adhesive ability than the lower press felt 14, and is transferred to the drying clothing 22 by way of the open draw 16. The suction box 36 is disabled during normal operation, as is the squirt pipe 31 in the open draw 16, the couch squirt 8, and the blower 37.

When a web rupture occurs in any of the open draws 16, 27 and, possibly, 26, this is detected by the detector 44, 45 arranged in the open draw in which the web rupture has occurred. The control unit 43 registers the signal regarding web rupture from the detector and processes the signal in order to emit control signals primarily to the squirt pipe 31, the screw jack 33 of the felt-deflection roll 32 for the upper press felt 12, and the suction box 36. If so desired, the control unit 43 can also emit a control signal to the screw jack 40 of the clothing-deflection roll 39 for the drying clothing 22. If the latter is disconnected from such automatic control, it can be activated manually, when this is considered necessary to facilitate threading. The squirt pipe 31, upon activation by the control unit 43, discharges a first curtain of jets of liquid against the upper press felt 12 so that the paper web 1 is prevented from accompanying the upper press felt 12 and instead forced downwards to the lower press felt 14 and a second curtain of jets of liquid which quickly increase the water content of the paper web 1 so that the paper web is weighted down against the lower press felt 14. If the web rupture has occurred in the drying section 4, this second curtain of jets of liquid will forcibly provide a web rupture in the open draw 16 between the guide rolls 13, 24*a*.

When the squirt pipe 31 is activated, the suction box 36 is simultaneously activated as is the screw jack 33 for moving the felt-deflection roll 32 of the upper press felt 12 to its lower threading position, whereby the paper web 1 is brought into contact with the lower press felt 14 and drawn by suction to continued adherence to the lower press felt 14. The paper web falls from the lower press felt 14 down into a reject-handling station 47, which collects and disintegrates the reject for re-utilization of the fibers. Thereafter, or somewhat earlier if possible, the couch squirt 8 is activated and moved in from a resting position at the side of the paper web 1 to a pre-determined inner position for dividing of the paper web 1 so that a leader of the desired width is obtained. When the leader arrives at the reject-handling station 47, the suction box 36 is disconnected and the blower 37 is activated, forcing the leader up against the drying clothing 22 and in between the same and the first drying cylinder 20. When the leader has been threaded through the drying section 4, the couch squirt 8 is moved across the machine direction during continued operation so that the paper web 1 is increased to full width. When the paper web 1 has obtained full width at the beginning of the drying section 4, the guide roll 13 of the upper press felt 12 is returned to its normal operating position, whereupon the paper web 1 will adhere to the upper press felt 12 up to the open draw 16 again.

The invention is not limited to the embodiment shown but may be varied in many ways within the scope of the appended claims. According to an alternative embodiment, the additional treatment unit for increasing the dry solids content of the paper web may be included in the press section and consist of a second press, which is arranged after the first press and which may be double-felted, with an open draw between the two presses, whereby the press section is followed by a drying section of the type shown in the drawings, for instance, with a closed draw therebetween or, alternatively, an open draw as shown in the drawings with (when the draw is open) or without (when the draw is closed) the web control system for handling of the paper web in the event of a web rupture as shown in the drawings. The press section shown in the drawings may also be provided with one or more presses upstream of the shoe press. Instead of the guide roll 13, a separate roll may be used as a felt-deflection roll, arranged in the loop of the upper press felt 12 in a position between the double-felted press nip and the guide roll 13 so that the suction box is located upstream of this separate felt-deflection roll. In accordance with yet another alternative embodiment (not shown), the felt-deflection device is instead arranged in the loop of the lower press felt 14 in a position downstream of the guide roll 13, preferably also downstream of the first guide roll 24*a* of the drying section, whereby the clothing-deflection device 38 in the drying section may be omitted depending on the mutual positions of the guide rolls 13, 24*a*. In this case, the suction box 36 is movable up and down in order to follow the deflection of the lower press felt enabling it to exert its suction effect on the paper web. Instead of arranging the felt-deflection device 32 pivotable about an outer pivot point as shown in the drawings, the felt-deflection roll may be mounted for linear movement.

It will be appreciated that, in accordance with the invention, the web control system is also activated on start-up of the paper machine, when it is advisable to disconnect the squirt pipe 31.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A paper machine for manufacturing a continuous paper web, comprising:

a wet section;

a press section including a double-felted press having a first press member and a second press member defining a nip therebetween, a first press felt arranged to travel in a loop through the press nip and around a first guide roll located downstream of the press nip, and a second press felt arranged to travel in a loop through the press nip and around a second guide roll located downstream of the press nip, the guide rolls being located in relation to each other such that the press felts normally diverge from each other after the press nip;

a treatment unit located downstream of the double-felted press for increasing the dry solids content of the web, wherein the web during normal operation traverses an open draw downstream of the press nip and upstream of the treatment unit; and a web control system activatable upon a rupture of the web in said open draw so as to exert force on the web to prevent the web from adhering to and traveling with the first press felt beyond the first guide roll such that the web downstream of the first guide roll travels on the second press felt.

2. The paper machine of claim 1, further comprising a detector operable to detect a web rupture in said open draw, and a controller connected with the detector and with the web control system, the controller activating the web control system upon receipt of a signal from the detector indicating that a web rupture has occurred in said open draw.

3. The paper machine of claim 1, wherein the web control system comprises at least one of:

a water-application device arranged proximate said open draw and the first press felt and operable to discharge jets of water across and against the first press felt so as to prevent an upstream end of the web resulting from the web rupture from adhering to the first press felt;

a felt-deflection device disposed downstream of the press nip and operable to deflect one of the first and second press felts toward the other so as to bring the two press felts into contact with each other downstream of the press nip with the web sandwiched therebetween; and a suction device arranged in the loop of the second press felt downstream of the press nip, the suction device being operable to apply suction through the second press felt upon a web rupture in said open draw so as to temporarily attach the web to the second press felt.

4. The paper machine of claim 3, wherein the web control system comprises the felt-deflection device and the suction device, the felt-deflection device and suction device being located relative to each other such that activation of the felt-deflection device causes the first and second press felts to be relatively moved toward each other to create a sandwich construction of the web between the two press felts, which sandwich construction is adjacent the suction device.

5. The paper machine of claim 4, wherein the felt-deflection device comprises a movable guide roll disposed within the loop of one of the press felts, the movable guide roll being movable so as to deflect said one of the press felts toward the other to create the sandwich construction.

6. The paper machine of claim 5, wherein the movable guide roll is disposed within the loop of the first press felt and the suction device is adjacent a surface of the second press felt that faces away from the movable guide roll.

7. The paper machine of claim 6, wherein the first guide roll for the first press felt is movable and forms the movable guide roll of the felt-deflection device.

8. The paper machine of claim 7, wherein the felt-deflection device includes an actuator coupled with the first guide roll for moving the first guide roll so as to create the sandwich construction.

9. The paper machine of claim 3, wherein the web control system comprises the water-application device, the felt-deflection device, and the suction device.

10. The paper machine of claim 3, wherein the web control system comprises the water-application device, and the water-application device includes nozzles oriented to discharge jets of water into said open draw for severing the web upon detection of an abnormal condition in the treatment unit.

11. The paper machine of claim 10, further comprising a detector arranged in the treatment unit for detecting an abnormal condition therein, and a controller coupled with the detector and with the water-application device for activating the water-application device to sever the web in the open draw upon receipt of a signal from the detector indicating occurrence of an abnormal condition in the treatment unit.

12. The paper machine of claim 10, wherein the water-application device is operable to cause the web to adhere to and travel with the second press felt downstream of the press nip.

13. The paper machine of claim 12, further comprising a reject-handling station downstream of the loop of the second press felt for receiving web material that is carried by the second press felt after the press nip.

14. The paper machine of claim 3, wherein the treatment unit includes a clothing arranged in a loop about a plurality of guide rolls and in contact with at least one treatment roll, and wherein a clothing-deflection device is arranged in the loop of said clothing and is operable to move the clothing into contact with the second press felt.

15. The paper machine of claim 14, wherein the web control system comprises the felt-deflection device in the form of a movable guide roll disposed within the loop of the first press felt, the movable guide roll being movable in concert with the clothing-deflection device to move the first press felt and the clothing into contact with the second press felt.

16. The paper machine of claim 3, wherein the web control system comprises the water-application device, the felt-deflection device, and the suction device, and further comprising a detector operable to detect a web rupture in said open draw, and a controller connected with the detector and with the web control system, the controller activating the web control system upon receipt of a signal from the detector indicating that a web rupture has occurred in said open draw.

17. A system for controlling a paper web in a paper machine upon rupture of the web along an open draw downstream of a press nip, the press nip being defined between first and second press members respectively disposed within loops of first and second press felts, the two press felts being guided by guide rolls so as to diverge from each other after the press nip, said system comprising:

a water-application device arranged proximate said open draw and the first press felt and operable to discharge jets of water across and against the first press felt so as to prevent an upstream end of the web resulting from the web rupture from adhering to and traveling with the first press felt downstream of the press nip;

a felt-deflection device disposed downstream of the press nip and operable to deflect one of the first and second press felts toward the other so as to bring the two press felts into contact with each other downstream of the press nip with the web sandwiched therebetween; and a suction device arranged in the loop of the second press felt downstream of the press nip, the suction device being operable to apply suction through the second press felt upon a web rupture in said open draw so as to temporarily attach the web to the second press felt.

18. The system of claim 17, further comprising:

a detector proximate said open draw and operable to detect a rupture of the web in said open draw; and a controller coupled with the detector and with the water-application device, the felt-deflecting device, and the suction device, the controller being operable to activate said devices upon receipt of a signal from the detector indicating that a rupture has occurred.

19. The system of claim 17 adapted for use in a paper machine having a treatment unit downstream of the press nip for increasing the dry solids content of the web, the treatment unit having a clothing traveling in a loop about a plurality of guide rolls and in contact with at least one treatment roll, the system further comprising a clothing-deflection device arranged in the loop of the clothing and operable to move the clothing into contact with the second press felt for facilitating threading a leading end of the web into the treatment unit.

20. A method for controlling a path of travel of a paper web in a paper machine upon rupture of the web along an open draw downstream of a press nip of the paper machine, the press nip being defined between first and second press members respectively disposed within loops of first and second press felts, the two press felts being guided by guide rolls so as to diverge from each other after the press nip and to separate from the web such that the web travels along said open draw during normal operation, said method comprising:

detecting a rupture of the web along said open draw;

directing one or more jets of fluid against and across the first press felt upon detection of the rupture so as to urge the web away from the first press felt and toward the second press felt; and deflecting one of the press felts toward the other upon detection of the rupture so as to cause the press felts to come together with the web sandwiched therebetween.

21. The method of claim 20, further comprising applying suction through the second press felt upon detection of the rupture, the suction being applied in a region of the second press felt at which the web is sandwiched between the two press felts so as to urge the web against the second press felt.

22. The method of claim 20, wherein directing fluid jets comprises directing jets of water against the first press felt in a direction generally toward the second press felt.

23. The method of claim 20, further comprising:

detecting an abnormal condition in the paper machine downstream of the open draw; and directing jets of fluid into the open draw upon detection of said abnormal condition so as to sever the web traveling over said open draw.

* * * * *